US010464361B2

(12) United States Patent
Omenetto et al.

(10) Patent No.: US 10,464,361 B2
(45) Date of Patent: Nov. 5, 2019

(54) SILK WATER LITHOGRAPHY

(71) Applicant: TUFTS UNIVERSITY, Medford, MA (US)

(72) Inventors: Fiorenzo G. Omenetto, Lexington, MA (US); David L. Kaplan, Concord, MA (US); Miaomiao Yang, Medford, MA (US); Hu Tao, Medford, MA (US); Benedetto Marelli, Somerville, MA (US); Sunghwan Kim, Malden, MA (US)

(73) Assignee: Tufts University, Medford, MA (US)

( * ) Notice: Subject to any disclaimer, the term of this patent is extended or adjusted under 35 U.S.C. 154(b) by 1086 days.

(21) Appl. No.: 14/776,236

(22) PCT Filed: Mar. 14, 2014

(86) PCT No.: PCT/US2014/029598

§ 371 (c)(1),
(2) Date: Sep. 14, 2015

(87) PCT Pub. No.: WO2014/144971

PCT Pub. Date: Sep. 18, 2014

(65) Prior Publication Data

US 2016/0046138 A1 Feb. 18, 2016

Related U.S. Application Data

(60) Provisional application No. 61/791,358, filed on Mar. 15, 2013, provisional application No. 61/788,520, filed on Mar. 15, 2013.

(51) Int. Cl.
*B41M 5/00* (2006.01)

(52) U.S. Cl.
CPC ..... *B41M 5/0047* (2013.01)

(58) Field of Classification Search
None
See application file for complete search history.

(56) References Cited

U.S. PATENT DOCUMENTS 4,186,224 A * 1/1980 Grillo ..... B41M 5/155 427/150
5,245,012 A 9/1993 Lombari et al.
6,902,932 B2 6/2005 Altman et al.
7,417,112 B2 * 8/2008 Rathore ..... C07K 14/43536 530/300

(Continued)

FOREIGN PATENT DOCUMENTS

JP H07-292306 A 11/1995
WO WO-97/08315 A1 3/1997

(Continued)

OTHER PUBLICATIONS

U.S. Appl. No. 61/791,358, filed Mar. 15, 2013, Omenetto et al.

(Continued)

*Primary Examiner* — Alejandro Valencia
(74) *Attorney, Agent, or Firm* — Quarles & Brady LLP; James M. Schleicher

(57) ABSTRACT

The present invention provides compositions and methods for printing a predetermined pattern on silk fibroin materials using water based "inks." Such technique may be useful for micro- and nano-engineering applications.

20 Claims, 6 Drawing Sheets

Specification includes a Sequence Listing.

Print water on silk film (water-lithography)

(56) References Cited

U.S. PATENT DOCUMENTS

| | | | |
|---|---|---|---|
| 7,635,755 | B2 | 12/2009 | Kaplan et al. |
| 8,195,021 | B2 | 6/2012 | Kaplan et al. |
| 2007/0187862 | A1 | 8/2007 | Kaplan et al. |
| 2010/0070068 | A1 | 3/2010 | Kaplan et al. |
| 2011/0293898 | A1 | 12/2011 | Yatake et al. |
| 2012/0121820 | A1 | 5/2012 | Kaplan et al. |
| 2012/0268519 | A1 | 10/2012 | Ohya et al. |
| 2016/0033861 | A1 | 2/2016 | Omenetto et al. |

FOREIGN PATENT DOCUMENTS

| | | | |
|---|---|---|---|
| WO | WO-03/056297 | A2 | 7/2003 |
| WO | WO-2004/000915 | A2 | 12/2003 |
| WO | WO-2004/062697 | A2 | 7/2004 |
| WO | WO-2005/000483 | A1 | 1/2005 |
| WO | WO-2005/012606 | A2 | 2/2005 |
| WO | WO-2005/12606 | A2 | 2/2005 |
| WO | WO-2005/123114 | A2 | 12/2005 |
| WO | WO-2007/016524 | A2 | 2/2007 |
| WO | WO-2008/118133 | A2 | 10/2008 |
| WO | WO-2008/118211 | A2 | 10/2008 |
| WO | WO-2008/127401 | A2 | 10/2008 |
| WO | WO-2008/127402 | A2 | 10/2008 |
| WO | WO-2008/127403 | A2 | 10/2008 |
| WO | WO-2008/127404 | A2 | 10/2008 |
| WO | WO-2008/127405 | A2 | 10/2008 |
| WO | WO-2008/140562 | A2 | 11/2008 |
| WO | WO-2008/150861 | A1 | 12/2008 |
| WO | WO-2009/061823 | A1 | 5/2009 |
| WO | WO-2009/155397 | A2 | 12/2009 |
| WO | WO-2010/126640 | A2 | 11/2010 |
| WO | WO-2011/012931 | A1 | 2/2011 |
| WO | WO-2011/026101 | A2 | 3/2011 |
| WO | WO-2011/046652 | A2 | 4/2011 |
| WO | WO-2011/115643 | A1 | 9/2011 |
| WO | WO-2011/130335 | A2 | 10/2011 |
| WO | WO-2011/160098 | A2 | 12/2011 |
| WO | WO-2012/031282 | A2 | 3/2012 |
| WO | WO-2012/047682 | A2 | 4/2012 |
| WO | WO-2012/054121 | A2 | 4/2012 |
| WO | WO-2012/094436 | A2 | 7/2012 |
| WO | WO-2012/145739 | A1 | 10/2012 |
| WO | WO-2013/103424 | A2 | 7/2013 |
| WO | WO-2013/130156 | A2 | 9/2013 |
| WO | WO-2014/144971 | A1 | 9/2014 |
| WO | WO-2014/197093 | A2 | 12/2014 |

OTHER PUBLICATIONS

Amsden et al., Spectral analysis of induced color change on periodically nanopatterned silk films, Optics Express 17(23): 21271-21279 (2009).

Amsden, J.J. et al., Rapid Nanoimprinting of Silk Fibroin Films for Biophotonic Applications, Advanced Materials, 22(15):1746-1749 (2010).

Bae et al., Fabrication of Poly(ethylene glycol) Hydrogel Structures for Pharmaceutical Applications using Electron beam and Optical Lithography, J. Vac. Sci., Technol. 28(6); C6P24-C6P29 (2010).

Bini et al., Mapping Domain Structures in Silks from Insects and Spiders Related to Protein Assembly, J. Mol. Biol. 335: 27-40 (2004).

Brenckle, M.A. et al., Protein-protein nanoimprinting of silk fibroin films, Advanced Materials, 25:(17) 2409-2414 (2013).

Chen et al., Noncovalent functionalization of carbon nanotubes for highly specific electronic biosensors., PNAS 100(9): 4984-4989 (2003).

Chen, W. & Ahmed H. Fabrication of 5-7 nm wide etched lines in silicon using 100 ke V electron-beam lithography and polymethylmethacrylate resist. Appl. Phys. Lett. 62: 1499-1501 (1993).

Dowling, J.P. et al., The photonic band edge laser: A new approach to gain enhancement. J. Appl. Phys. 75:1896 (1994).

Duan, H. et al., Sub-10 nm half-pitch electron-beam lithography by using poly(methylmethacrylate) as a negative resist. J. Vac. Sci. Technol. B 28: 1071-1023 (2010).

Fan et al., Sensitive optical biosensors for unlabeled targets: a review. Anal Chim. Acta 620(1-2): 8-26 (2008).

Ferrini, R. et al., Radiation losses in planar photonic crystals: two dimensional representation of hole depth and shape by an imaginary dielectric constant. J. Opt. Soc. Am. B 20: 469-478 (2003).

Hennink, WE and van Nostrum, CF., Novel crosslinking to design hydrogels., Adv. Drug Deliv. Rev. 54(1): 13-36 (2002).

Hu, X et al., Determining beta-sheet crytallinity in bribrous proteins by thermal analysis and infrared spectroscopy. Macromolecules 39: 6161-6170 (2006).

Hu, X et al., Regulation of silk material structure by temperature-controlled water vapor annealing, Biomacromolecules 12: 1686-1696 (2011).

Hu, X. et al., Dynamic protein-water relationships during β-sheet formation. Micromolecules 41: 3939-3948 (2008).

International Search Report for PCT/US2014/029571, 5 pages (dated Dec. 23, 2014).

International Search Report for PCT/US2014/029598, 6 pages (dated Jul. 10, 2014).

Jin, H-J. et al., Water-Stable Silk Films with Reduced β-Sheet Content, Adv. Funct. Mater. 15:1241-1247 (2005).

Jin, H.J, and Kaplan, D.L, Mechanism of silk processing in insects and spiders, Nautre 424:1057-1061 (2003).

Johnson, S.G. & Joannopoulos, J.D. Block-iterative frequency-domain methods for Maxwell's equations in a planewave basis. Opt. Express 8(3):173-190 (2001).

Kikuchi, Y. et al, Structure of the Bombyx mori fibroin light-chain-encoding gene: upstreme sequence elements common to the light and heavy chain, Gene 110: 151-159 (1992).

Kim, D.H. et al., Dissolvable films of silk fibroin for ultrathin conformal bio-integrated electronics, Nature Mater. 9(6): 511-517 (2010).

Kim, S. et al., Fiber-coupled surface-emitting photonic crystal band edge laser for biochemical sensor applications. Appl. Phys. Lett. 94: 133503 (2009).

Kim, S. et al., Silk inverse opals. Nature Photon. 6: 818-823 (2012).

Kim, U-J. et al., Structure and Properties of Silk Hydrogels, Biomacromol., 5:786-792 (2004).

Kojthung, A. et al., Effects of gamma radiation on biodegradation of Bombyx mori silk fibroin. Int. Biodeterioration & Biodegradation 62: 487-490 (2008).

Lawrence, B.D. et al., Bioactive Silk Protein Biomaterial Systems for Optical Devices., Biomacromolecules 9: 1214-1220 (2008).

Liu, J et al., Radiation grafting/crosslinking of silk using electron-beam irradiation. J. Appl. Poly. Sci. 91: 2028-2034 (2004).

Lu, Q. et al., Stabilization and release of enzymes from silk films, Macromol. Biosci., 10(4):359-68 (2010).

Lucas et al., The Silk Fibroins, Adv. Potein Chem. 13: 107-242 (1958).

Martiradonna, L.et al., Lithiographic nano-patterning of colloidal nanocrystal emitters for the fabrication of waveguide photonic devices. Sens. Act. B 126: 116-119 (2007).

Mondia J.P. et al., Rapid nanoimprinting of doped silk films for enhanced flourescent emission. Adv. Mater. 22: 4596-4599 (2010).

Nazarov, R. et al., Porous 3-D Scaffolds from Regenerated Silk Fibroin., Biomacromolecules 5: 715-726 (2004).

Omenetto, F.G. and Kaplan, D., A new route for silk, Nature Photonics 2: 641-643 (2008).

Omentetto, F.G. and Kaplan, D.L., New Opportunities for an ancient material, Scienec 329: 528-531 (2010).

Parker et al., Biocompatible Silk Printed Optical Waveguides, Adv. Mater. 21:1-5 (2009).

Pedelacq, J.-D. et al., Engineering and characterization of a superfolder green flourescent protein., Nature Biotech. 24(1): 79-88 (2005).

Perry, H. et al., Nano- and micropatterning of opitcally transparent, mechanically robust, biocompatible silk fibroin films. Adv. Mater 20:3070-3072 (2008).

Pritchard, E.M, et al., Physical and chemical aspects of stabilization of compounds in silk, Biopolymars 97(6): 479-498 (2012).

(56) References Cited

OTHER PUBLICATIONS

Solak, H.H. et al., Multiple-beam interference lithography with electron beam written gratings. J. Vac. Sci & Technol. B 20: 2844-2848 (2002).
Takei, F. et al., Further Evidence for Importance of the Subunit Combination of Silk Fibroin in its Efficient secretion from the Posterior Silk Gland Cells, J Cell Biol. 105: 175-180 (1987).
Tan, Y. et al., Gold-nanoparticle-infiltrated polystyrene inversopals: A Three-dimensional platform for generating combined optical properties. Chem. Mater 18(15): 3385-3389 (2006).
Tanaka, K. et al., Determination of the site of disulfide linkage between heavy and light chains of silk fibroin produced by Bombyx mori, Biochim. Biophys. Acta 1432: 92-103 (1999).
Tanaka, K. et al., Immunological Identification of the Major Disulfide-Linked Light Component of Silk Fibroin, J. Biochem 114(1): 1-4 (1993).
Tao, H. et al., Silk Materials—A road to sustainable high technology, Adv. Mater. 24(21)L 2824-2837 (2012).
Tarhan, I.I. and Watson, G.H, Photonic band Structure of fcc colloidal crystals, Phys. Rev. Lett. 76(2): 315-318 (1996).
Tearney, G.J. et al., In vivo endoscopic optical biopsy with optical coherence tomography, Science 276(5321): 2037-2039 (1997).
Tsioris, K. et al., Rapid Transfer-based micropatterning and dry etching of silk microstructures, Adv. Mater. 23(17): 2015-2019 (2011).
Valluzzi, R., et al., Orientation of silk III at the air-water interface, Int. J. Biol. Macromol., 24(2-3): 237-242 (1999).
Written Opinion for PCT/US2014/029571, 7 pages (dated Dec. 23, 2014).
Written Opinion for PCT/US2014/029598, 6 pages (dated Jul. 10, 2014).
Zhou et al., Fine Organization of Bombyx mori fibroin heavy chain gene, Nucl. Acids Res. 28(12): 2413-2419 (2000).

* cited by examiner

Print water on silk film (water-lithography)

Negative water-lithography

Method:
1. Mix Tween with water
2. Directly print pattern
3. Rinse in the water to develop the pattern Negative water-lithography patterns Silk lines after being developed in water

SILK WATER LITHOGRAPHY

CROSS REFERENCE TO RELATED APPLICATIONS

This patent application is a National Stage Entry of International Application No. PCT/US2014/029598, filed on Mar. 14, 2014 "SILK WATER LITHOGRAPHY," which claims the benefit of and priority to U.S. Provisional Application 61/791,358, filed on Mar. 15, 2013 and entitled "SILK WATER LITHOGRAPHY," the entire contents of each of which are hereby incorporated herein by reference. This application also relates to U.S. Provisional Application Ser. No. 61/788,520, filed Mar. 15, 2013 and entitled "ALL WATER-BASED NANOPATTERNING," the entire contents of which are herein incorporated by reference.

BACKGROUND

Silk fibroin proteins represent a discrete family of biopolymers due to their unique structural and biological properties. Silks spun by spiders and silkworms represent the strongest and toughest natural fibers known and offer unlimited opportunities for functionalization, processing, and biological integration.

Recent progress has led to the transformation of this ancient and commodity material, in particular silkworm silk, into a variety of new material formats including, hydrogels, ultrathin films, thick films, conformal coatings, 3D porous or solid matrices, particles, fibers and many related material formats. Silk is processed in an all water-based, room temperature, neutral pH environment, is mechanically stable, edible, biocompatible, and implantable in the human body.

SUMMARY OF THE INVENTION

Among other things, the present invention encompasses the recognition that it is possible to carry out truly green methods of printing by the use of a silk fibroin-based material as a printing surface, and a water-based ink.

The invention is based, at least in part, on the recognition that silk fibroin materials can be prepared to transition between the two predominant forms: water-soluble and water-insoluble structures. Based on this principle, the process of water lithography has been developed, in which "printing" is controlled by differential crystallinity of silk fibroin, e.g., either soluble or insoluble silk.

According to some embodiments of the invention, therefore, a silk film replaces a sheet of printing paper, while water is used as "ink" which replaces conventional ink. A conventional, commercially available inkjet printer may be employed to carry out such direct printing. Both "positive" water lithography and "negative" water lithography have been demonstrated and described herein.

DETAILED DESCRIPTION OF CERTAIN EMBODIMENTS

Figure 1:
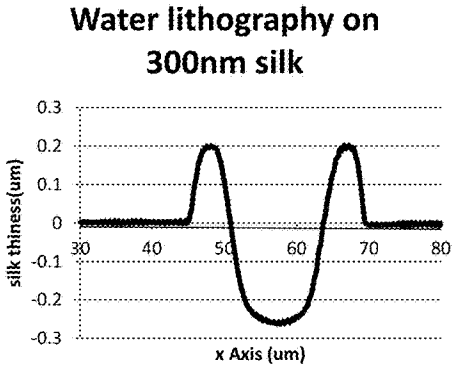
FIG. 1 provides no-limiting embodiments of water lithography using silk fibroin films of different thickness. The graphs depict effects of "water" used as an ink to "print" (e.g., alter the structure of the solid, water-soluble silk films) upon deposition.
Figure 1:
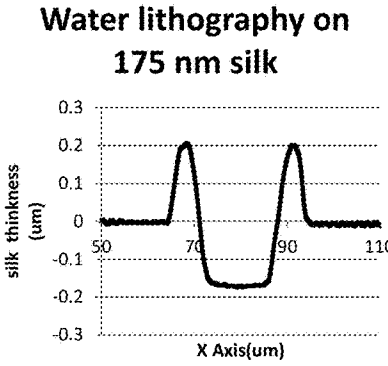
Figure 2:
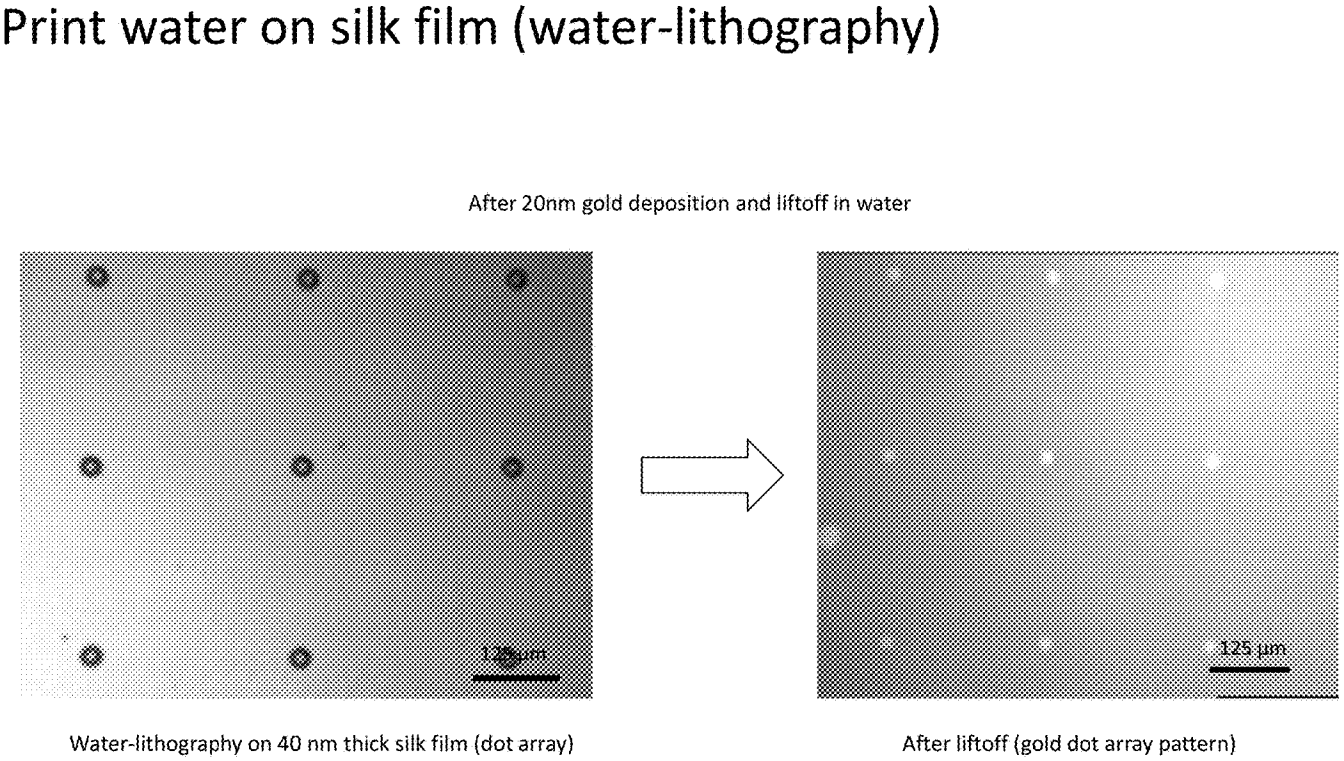
FIG. 2 provides images of dot array and gold dot array using the water lithography technique as described.
Figure 3:
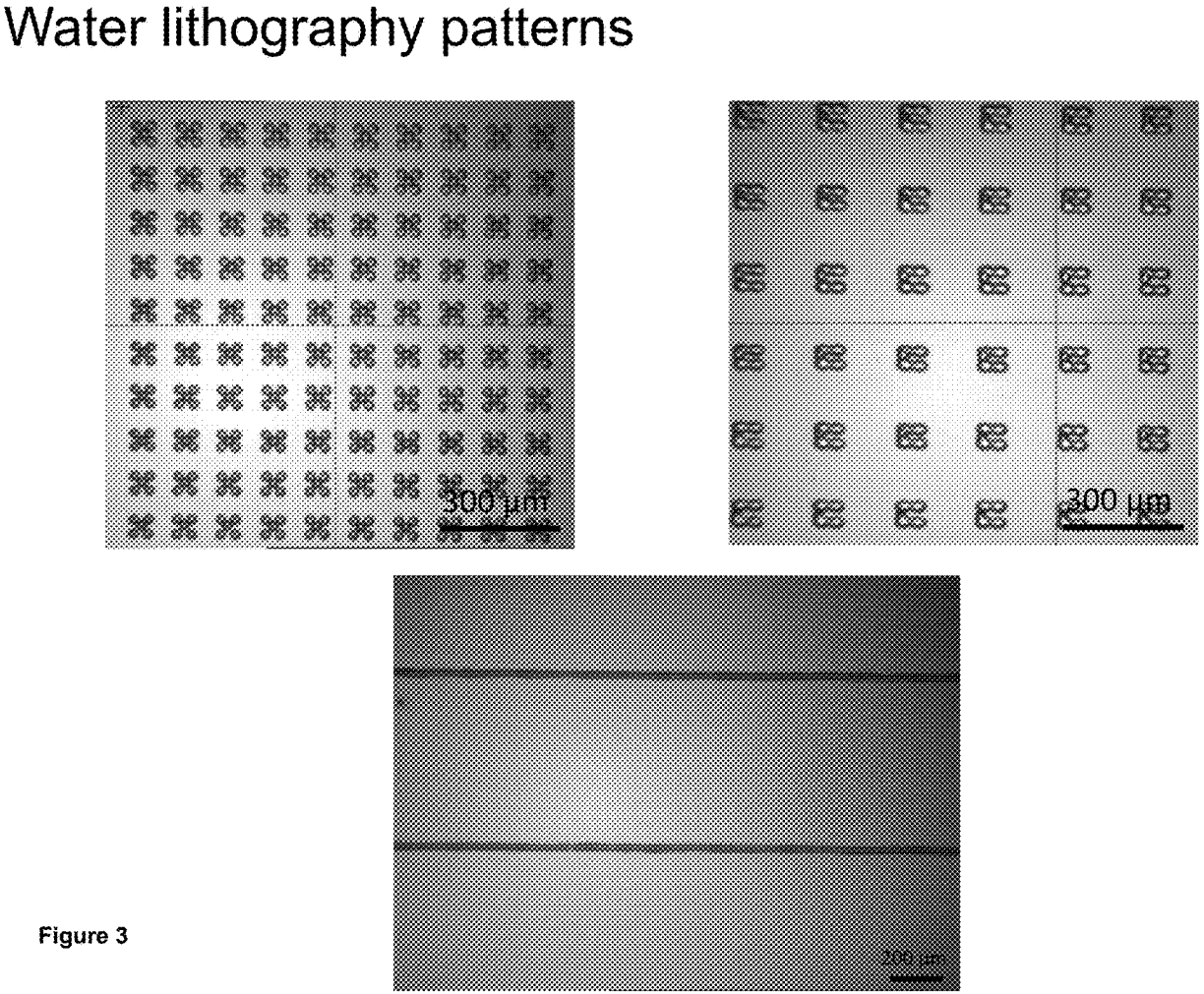
FIG. 3 provides images showing a variety of lithography patterns generated by water lithography described herein.

Among the many possible material forms, silk fibroin films are of particular interest for micro- and/or nanotechnologies, electronics, optics and photonics applications due to their superior surface flatness and extraordinary optical transparency.

The solubility of silk films depends on the crystalline level within the silk matrix. Therefore, it is feasible to apply controllable amount of water based solution to selectively dissolve or crosslink localized region (for positive and negative lithography, respectively) within the substrates for micro- and nano patterning, which can be implemented for a variety of controlled eco-friendly fabrication on the micro- and nano-scale.

In some embodiments water based lithography described herein is carried out to print a desirable pattern on silk fibroin materials, such as silk fibroin films, with or without a substrate.

In some embodiments, such a film has a thickness of between about 20 nm and about 1,000 nm, e.g., between about 20-900 nm, between about 20-850 nm, between about 20-800 nm, between about 20-750 nm, between about 20-700 nm, between about 20-650 nm, between about 20-600 nm, between about 20-550 nm, between about 20-500 nm, between about 20-450 nm, between about 20-400 nm, between about 20-350 nm, between about 20-300 nm, between about 20-250 nm, between about 20-200 nm, between about 20-150 nm, between about 20-100 nm, between about 20-90 nm, between about 20-80 nm, between about 20-70 nm, between about 20-60 nm, between about 20-50 nm, between about 20-40 nm, between about 20-30 nm, between about 50 nm and about 1,000 nm, e.g., between about 50-900 nm, between about 50-850 nm, between about 50-800 nm, between about 50-750 nm, between about 50-700 nm, between about 50-650 nm, between about 50-600 nm, between about 50-550 nm, between about 50-500 nm, between about 50-450 nm, between about 50-400 nm, between about 50-350 nm, between about 50-300 nm, between about 50-250 nm, between about 50-200 nm, between about 50-150 nm, between about 50-100 nm, between about 50-90 nm, between about 50-80 nm, between about 50-70 nm, between about 50-60 nm, between about 100 nm and about 1,000 nm, e.g., between about 100-900 nm, between about 100-850 nm, between about 100-800 nm, between about 100-750 nm, between about 100-700 nm, between about 100-650 nm, between about 100-600 nm, between about 100-550 nm, between about 100-500 nm, between about 100-450 nm, between about 100-400 nm, between about 100-350 nm, between about 100-300 nm, between about 100-250 nm, between about 100-200 nm, between about 100-150 nm.

Accordingly, the present application provides, among other things, water-based lithography methods which enable printing of nano- and micro-scale patterns on silk fibroin-based surfaces. A water-based solution can selectively dissolve or crosslink the silk fibroin material (such as silk films) for both positive and negative lithography applications.

According to the invention, shapes and or patterns that can be formed or printed using water based lithography described herein on silk fibroin materials (e.g., films) are limitless, simply depending on any suitable printing means, such as the available inkjet printers. The printable silk patterns include, but are not limited to: lines, dots, curves, solids, and any combination thereof. In some embodiments, any desirable pattern may be printed in accordance with the methods described herein in a predetermined pattern.

In some embodiments, the silk fibroin nanostructures produced according to any of the methods in this disclosure include a variety of patterned features, such as repeated features. For example, the features may be a series of holes (i.e., an array of holes) with diameters ranging from about 20 nm to about 200 nm. In some embodiments, the diameter may be between about 20 nm and about 30 nm, between about 20 nm and about 50 nm, between about 20 nm and about 100 nm, between about 30 nm and about 100 nm, between about 30 nm and about 200 nm, between about 50 nm and about 100 nm, between about 50 nm and about 200 nm or, between about 100 nm and about 200 nm. In some embodiments, the diameter is expressed as a ratio or proportion of the distance between features in a pattern (e.g., the lattice constant, Λ,). In some embodiments, the diameter is between about 0.1Λ and about 0.5Λ (e.g, one tenth or one half of the distance between features, respectively).

Though such features may commonly be described as holes, they have any varying depth, from a few nanometers from the surface of the silk biopolymer layer to penetrating through the entire thickness of silk fibroin materials. Furthermore, the cross-sectional shape of a feature, though commonly described as a hole, implying a circular or elliptical cross-sectional shape, the features may instead by any cross-sectional shape (e.g., rectangular, hexagonal, elongated, or line). Further, the cross-sectional shape of a feature may vary with depth depending on the application or process parameters in patterning. In instances in which the cross-section shape of a feature is not circular, the diameters described above may related to a primary dimension of the feature (e.g. major/minor axis, diagonal, width, etc.,).

The patterns formed can vary. Though generally arrays of features, the patterns can ordered or random. In some embodiments, the ordered arrays can be rectangular, square, triangular or circular, depending on the use of the patterned silk product.

The diameters and distance between holes/voids of a nanopattern are key determinant factors to colors to be generated. See for example, PCT/US2012/068046, which is incorporated herein by reference in its entirety.

Using this process described herein, it is feasible to construct photonic structures, such as photonic crystals (PhCs) and diffractive gratings with nano-scale feature sizes and high aspect ratios. Furthermore, using the methods described in the present invention, PhC structures further comprising additional components. To give but one example, PhC structures may include a light-sensitive element, which exhibit enhanced light-responsive signaling, providing evidence for the operativity of the present invention. Because the manufacture and operational processes are entirely water-based and can be performed under ambient environment, it provides ample flexibility as to biological applications.

Further, the features may be spaced apparent from each other at regular intervals. The spacing between features may vary from between about 50 nm to about 1000 nm (i.e., 1 μm). For example, the distance between features may be between about 50 nm and about 100 nm, between about 50 nm and about 300 nm, between about 50 nm and about 500 nm, between about 100 nm and about 200 nm, between about 100 nm and about 500 nm, between about 200 nm and about 300 nm, between about 200 nm and about 500 nm, between about 200 nm and about 1000 nm, between about 300 nm and about 500 nm, between about 300 nm and about 1000 nm, between about 500 nm and about 1000 nm. In some embodiments, in the context of photonic crystals, for example, the distance between features is referred to as the lattice constant and given the symbol Λ.

Silk Fibroin

Silk fibroin useful for carrying out the present invention includes a wide variety of silk fibroin polypeptide, fragments thereof, including preparations extracted from native sources, produced recombinantly, or chemically synthesized.

Fibroin is a type of structural protein produced by certain spider and insect species that produce silk. Silk fibers, such as those produced by silkworms or spiders, can be processed into silk fibroin which can then be processed into various forms including silk solutions (Jin & Kaplan, 424 Nature 1057 (2003)), gels (Jim et al., 5 Biomacromol. 786 (2004)), foams (Nazarov et al., 5 Biomacromol. 718 (2004)), and films (Jin et al., 15 Adv. Functional Mats. 1241 (2005); Amsden et al., 17 Optics Express 21271 (2009)). Various processing options enable its use as a supporting and packaging material for implanted micro and medical devices. In addition, silk fibroins matrices have outstanding biocompatibility, and excellent mechanical and optical properties, which make these materials well suited for a variety of implantable medical devices (IMDs). See, for example, Omenetto & Kaplan, 2 Nature Photonics 641 (2008). Additionally, silk films can be patterned (in both 2D and 3D) to realize a number of optical elements such as diffractive gratings (Amsden et al., 22 Adv. Mats. 1746 (2010)), and wave guides (Parker et al., 21 Adv. Mats. (2009)), within the IMDs. Silk fibroins also provide a biologically favorable microenvironment that allow to entrainment of various biological and/or chemical dopants and maintain their functionality. Proteins (Bini et al., 335 J. Mol. Bio. 27 (2004)), enzymes (Lu et al., 10 Macromol. Biosci. 359 (2010)) and small organics (Lawrence et al., 9 Biomacromol. 1214 (2008)), have been incorporated into silk films for various biochemical functionalities.

Additionally, silk fibroin can be prepared in an all-aqueous process, further expanding its compatibility with biologics, manufacturing processes and the environment. As used herein, the term "silk fibroin" includes silkworm fibroin and insect or spider silk protein. See e.g., Lucas et al., 13 Adv. Protein Chem. 107 (1958). For example, silk fibroin useful for the present invention may be that produced by a number of species, including, without limitation: *Antheraea mylitta; Antheraea pernyi; Antheraea yamamai; Galleria mellonella; Bombyx mori; Bombyx mandarins; Galleria mellonella; Nephila clavipes; Nephila senegalensis; Gasteracantha mammosa; Argiope aurantia; Araneus diadematus; Latrodectus geometricus; Araneus bicentenarius; Tetragnatha versicolor; Araneus ventricosus; Dolomedes*

*tenebrosus; Euagrus chisoseus; Plectreurys tristis; Argiope trifasciata*; and *Nephila madagascariensis.*

In general, silk fibroin for use in accordance with the present invention may be produced by any such organism, or may be prepared through an artificial process, for example, involving genetic engineering of cells or organisms to produce a silk protein and/or chemical synthesis. In some embodiments of the present invention, silk is produced by the silkworm, *Bombyx mori.*

As is known in the art, native silk fibroins are modular in design, with large internal repeats flanked by shorter (~100 amino acid) terminal domains (N and C termini). Silk fibroins have high molecular weight (200 to 350 kDa or higher) with transcripts of 10,000 base pairs and higher and >3000 amino acids (reviewed in Omenetto and Kaplan (2010) Science 329: 528-531). The larger modular domains are interrupted with relatively short spacers with hydrophobic charge groups in the case of silkworm silk. N- and C-termini are involved in the assembly and processing of silks, including pH control of assembly. The N- and C-termini are highly conserved, in spite of their relatively small size compared with the internal modules. An exemplary list of silk-producing species and corresponding silk proteins may be found in International Patent Publication Number WO 2011/130335, the entire contents of which are incorporated herein by reference.

Cocoon silk produced by the silkworm, *Bombyx mori*, is of particular interest because it offers low-cost, bulk-scale production suitable for a number of commercial applications, such as textile. Silkworm cocoon silk contains two structural proteins, the fibroin heavy chain (~350 k Da) and the fibroin light chain (~25 k Da), which are associated with a family of nonstructural proteins termed sericin, which glue the fibroin brings together in forming the cocoon. The heavy and light chains of fibroin are linked by a disulfide bond at the C-terminus of the two subunits (Takei, F., Kikuchi, Y., Kikuchi, A., Mizuno, S. and Shimura, K. (1987) J. Cell Biol., 105, 175-180; Tanaka, K., Mori, K. and Mizuno, S. (1993) J. Biochem. (Tokyo), 114, 1-4; Tanaka, K., Kajiyama, N., Ishikura, K., Waga, S., Kikuchi, A., Ohtomo, K., Takagi, T. and Mizuno, S.(1999) Biochim. Biophys. Acta, 1432, 92-103; Y Kikuchi, K Mori, S Suzuki, K Yamaguchi and S Mizuno, Structure of the *Bombyx mori* fibroin light-chain-encoding gene: upstream sequence elements common to the light and heavy chain, Gene 110 (1992), pp. 151-158). The sericins are a high molecular weight, soluble glycoprotein constituent of silk which gives the stickiness to the material. These glycoproteins are hydrophilic and can be easily removed from cocoons by boiling in water.

As used herein, the term "silk fibroin" embraces silk fibroin protein, whether produced by silkworm, spider, or other insect, or otherwise generated (Lucas et al., Adv. Protein Chem., 13: 107-242 (1958)). In some embodiments, silk fibroin is obtained from a solution containing a dissolved silkworm silk or spider silk. For example, in some embodiments, silkworm silk fibroins are obtained, from the cocoon of *Bombyx mori*. In some embodiments, spider silk fibroins are obtained, for example, from *Nephila clavipes*. In the alternative, in some embodiments, silk fibroins suitable for use in the invention are obtained from a solution containing a genetically engineered silk harvested from bacteria, yeast, mammalian cells, transgenic animals or transgenic plants. See, e.g., WO 97/08315 and U.S. Pat. No. 5,245,012, each of which is incorporated herein as reference in its entirety.

Thus, in some embodiments, a silk solution is used to fabricate compositions of the present invention containing fibroin proteins, essentially free of sericins. In some embodiments, silk solutions used to fabricate various compositions of the present invention contain the heavy chain of fibroin, but are essentially free of other proteins. In other embodiments, silk solutions used to fabricate various compositions of the present invention contain both the heavy and light chains of fibroin, but are essentially free of other proteins. In certain embodiments, silk solutions used to fabricate various compositions of the present invention comprise both a heavy and a light chain of silk fibroin; in some such embodiments, the heavy chain and the light chain of silk fibroin are linked via at least one disulfide bond. In some embodiments where the heavy and light chains of fibroin are present, they are linked via one, two, three or more disulfide bonds.

Although different species of silk-producing organisms, and different types of silk, have different amino acid compositions, various fibroin proteins share certain structural features. A general trend in silk fibroin structure is a sequence of amino acids that is characterized by usually alternating glycine and alanine, or alanine alone. Such configuration allows fibroin molecules to self-assemble into a beta-sheet conformation. These "Ala-rich" hydrophobic blocks are typically separated by segments of amino acids with bulky side-groups (e.g., hydrophilic spacers).

In some embodiments, core repeat sequences of the hydrophobic blocks of fibroin are represented by the following amino acid sequences and/or formulae: $(GAGAGS)_{5-15}$ (SEQ ID NO: 1); $(GX)_{5-15}$ (X=V, I, A) (SEQ ID NO: 2); GAAS (SEQ ID NO: 3); $(S_{1-2}A_{11-13})$ (SEQ ID NO: 4); $GX_{1-4}$ GGX (SEQ ID NO: 5); GGGX (X=A, S, Y, R, D V, W, R, D) (SEQ ID NO: 6); $(S1\text{-}2A1\text{-}4)_{1-2}$ (SEQ ID NO: 7); GLGGLG (SEQ ID NO: 8); GXGGXG (X=L, I, V, P) (SEQ ID NO: 9); GPX (X=L, Y, I); $(GP(GGX)_{1-4}Y)n$ (X=Y, V, S, A) (SEQ ID NO: 10); GRGGAn (SEQ ID NO: 11); GGXn (X=A, T, V, S); $GAG(A)_{6-7}GGA$ (SEQ ID NO: 12); and GGX GX GXX (X=Q, Y, L, A, S, R) (SEQ ID NO: 13).

In some embodiments, a fibroin peptide contains multiple hydrophobic blocks, e.g., 3, 4, 5, 6, 7, 8, 9, 10, 11, 12, 13, 14, 15, 16, 17, 18, 19 and 20 hydrophobic blocks within the peptide. In some embodiments, a fibroin peptide contains between 4-17 hydrophobic blocks. In some embodiments of the invention, a fibroin peptide comprises at least one hydrophilic spacer sequence ("hydrophilic block") that is about 4-50 amino acids in length. Non-limiting examples of the hydrophilic spacer sequences include: TGSSGFGPYVNGGYSG (SEQ ID NO: 14); YEYAWSSE (SEQ ID NO: 15); SDFGTGS (SEQ ID NO: 16); RRAGYDR (SEQ ID NO: 17); EVIVIDDR(SEQ ID NO: 18); TTIIEDLDITIDGADGPI (SEQ ID NO: 19) and TISEELTI (SEQ ID NO: 20).

In certain embodiments, a fibroin peptide contains a hydrophilic spacer sequence that is a derivative of any one of the representative spacer sequences listed above. Such derivatives are at least 75%, at least 80%, at least 85%, at least 90%, or at least 95% identical to any one of the hydrophilic spacer sequences.

In some embodiments, a fibroin peptide suitable for the present invention contains no spacer.

As noted, silk fibroins are fibrous proteins and are characterized by modular units linked together to form high molecular weight, highly repetitive proteins. These modular units or domains, each with specific amino acid sequences and chemistries, are thought to provide specific functions. For example, sequence motifs such as poly-alanine (polyA) and polyalanine-glycine (poly-AG) are inclined to be beta-sheet-forming; GXX motifs contribute to 31-helix formation; GXG motifs provide stiffness; and, GPGXX (SEQ ID NO: 22) contributes to beta-spiral formation. These are examples of key components in various silk structures whose positioning and arrangement are intimately tied with the end material properties of silk-based materials (reviewed in Omenetto and Kaplan (2010) Science 329: 528-531).

It has been observed that the beta-sheets of fibroin proteins stack to form crystals, whereas the other segments form amorphous domains. It is the interplay between the hard crystalline segments, and the strained elastic semi amorphous regions, that gives silk its extraordinary properties. Non-limiting examples of repeat sequences and spacer sequences from various silk-producing species are provided in An exemplary list of hydrophobic and hydrophilic components of fibroin sequences may be found in International Patent Publication Number WO 2011/130335, the entire contents of which are incorporated herein by reference.

The particular silk materials explicitly exemplified herein were typically prepared from material spun by silkworm, *B. Mori*. The complete sequence of the *Bombyx mori* fibroin gene has been determined (C.-Z Zhou, F Confalonieri, N Medina, Y Zivanovic, C Esnault and T Yang et al., Fine organization of *Bombyx mori* fibroin heavy chain gene, Nucl. Acids Res. 28 (2000), pp. 2413-2419). The fibroin coding sequence presents a spectacular organization, with a highly repetitive and G-rich (~45%) core flanked by non-repetitive 5' and 3' ends. This repetitive core is composed of alternate arrays of 12 repetitive and 11 amorphous domains. The sequences of the amorphous domains are evolutionarily conserved and the repetitive domains differ from each other in length by a variety of tandem repeats of subdomains of ~208 bp.

The silkworm fibroin protein consists of layers of anti-parallel beta sheets whose primary structure mainly consists of the recurrent amino acid sequence (Gly-Ser-Gly-Ala-Gly-Ala)n (SEQ ID NO: 21). The beta-sheet configuration of fibroin is largely responsible for the tensile strength of the material due to hydrogen bonds formed in these regions. In addition to being stronger than Kevlar, fibroin is known to be highly elastic. Historically, these attributes have made it a material with applications in several areas, including textile manufacture.

Fibroin is known to arrange itself in three structures at the macromolecular level, termed silk I, silk II, and silk III, the first two being the primary structures observed in nature. The silk II structure generally refers to the beta-sheet conformation of fibroin. Silk I, which is the other main structure of silk fibroin, is a hydrated structure and is considered to be a necessary intermediate for the preorganization or prealignment of silk fibroin molecules. In the nature, silk I structure is transformed into silk II structure after spinning process. For example, silk I is the natural form of fibroin, as emitted from the *Bombyx mori* silk glands. Silk II refers to the arrangement of fibroin molecules in spun silk, which has greater strength and is often used commercially in various applications. As noted above, the amino-acid sequence of the β-sheet forming crystalline region of fibroin is dominated by the hydrophobic sequence. Silk fibre formation involves shear and elongational stress acting on the fibroin solution (up to 30% wt/vol.) in the gland, causing fibroin in solution to crystallize. The process involves a lyotropic liquid crystal phase, which is transformed from a gel to a sol state during spinning—that is, a liquid crystal spinning process. Elongational flow orients the fibroin chains, and the liquid is converted into filaments.

Silk III is a newly discovered structure of fibroin (Valluzzi, Regina; Gido, Samuel P.; Muller, Wayne; Kaplan, David L. (1999). "Orientation of silk III at the air-water interface". International Journal of Biological Macromolecules 24: 237-242). Silk III is formed principally in solutions of fibroin at an interface (i.e. air-water interface, water-oil interface, etc.). Silk can assemble, and in fact can self-assemble, into crystalline structures. Silk fibroin can be fabricated into desired shapes and conformations, such as silk hydrogels (WO2005/012606; PCT/US08/65076), ultra-thin films (WO2007/016524), thick films, conformal coatings (WO2005/000483; WO2005/123114), foams (WO 2005/012606), electrospun mats (WO 2004/000915), microspheres (PCT/US2007/020789), 3D porous matrices (WO2004/062697), solid blocks (WO2003/056297), microfluidic devices (PCT/US07/83646; PCT/US07/83634), electro-optical devices (PCT/US07/83639), and fibers with diameters ranging from the nanoscale (WO2004/000915) to several centimeters (U.S. Pat. No. 6,902,932). The above mentioned applications and patents are incorporated herein by reference in their entirety. For example, silk fibroin can be processed into thin, mechanically robust films with excellent surface quality and optical transparency, which provides an ideal substrate acting as a mechanical support for high-technology materials, such as thin metal layers and contacts, semiconductor films, dielectric powders, nanoparticles, and the like. These unique physiochemical properties of silk allows its use in a variety of applications such as those described herein. Furthermore, useful silk materials can be prepared through processes that can be carried out at room temperature and are water-based. Therefore, bio-molecules of interest can be readily incorporated into silk materials.

While a number of types of silk fibroin, such as those exemplified above, may be used to practice the claimed invention, silk fibroin produced by silkworms, such as *Bombyx mori*, is the most common and represents an earth-friendly, renewable resource. For instance, silk fibroin may be attained by extracting sericin from the cocoons of *B. mori*. Organic silkworm cocoons are also commercially available. There are many different silks, however, including spider silk (e.g., obtained from *Nephila clavipes*), transgenic silks, genetically engineered silks, such as silks from bacteria, yeast, mammalian cells, transgenic animals, or transgenic plants (see, e.g., WO 97/08315; U.S. Pat. No. 5,245,012), and variants thereof, that may be used. As already noted, an aqueous silk fibroin solution may be prepared using techniques known in the art. Suitable processes for preparing silk fibroin solution are disclosed, for example, in U.S. patent application Ser. No. 11/247,358; WO/2005/012606; and WO/2008/127401. The silk aqueous solution can then be processed into silk matrix such as silk films, conformal coatings or layers, or 3-dimensional scaffolds, or electrospun fibers. A microfiltration step may be used herein. For example, the prepared silk fibroin solution may be processed further by centrifugation and syringe based microfiltration before further processing into silk matrix.

In some embodiments of the invention described herein, a portion or portions of a silk fibroin material that is not immobilized or crosslinked have the beta-sheet content of not greater than about 35%, e.g., not greater than about 30%, not greater than about 25%, not greater than about 20%, not greater than about 15%, or not greater than about 10%.

In some embodiments of the invention described herein, a portion or portions of a silk fibroin material that is immobilized or crosslinked have the beta-sheet content of at least about 35%, e.g., at least about 40%, at least about 45%, at least about 50%, at least about 55%, or at least about 60%. at least about 65%, at least about 70%, at least about 75%, at least about 80%, at least about 85%, at least about 90%.

The invention also contemplates the use of materials made of silk fibroin having high molecular weight fragments, silk fibroin made of low molecular weight fragments, or mixtures containing various ratios of such fragments. Typically, "low molecular weight fragments" of silk fibroin refer to silk fibroin fragments having average molecular weights that range between about 3.5 kDa and 120 kDa. Typically, "high molecular weight fragments" of silk fibroin refer to silk fibroin fragments having average molecular weights that are greater than 120 kDa, e.g., about 150 kDa, about 200 kDa, about 250 kDa, about 300 kDa, and about 350 kDa.

In some embodiments, additional features may be incorporated for functionalization, including biological functionalization. The ability to easily dope silk with either inorganic and/or organic dopants provides augmented utility by allowing innumerable combinations of functionalized printed silk materials to be generated.

In particular, methods described herein can be effectively adapted to include dopants that are biological in nature, such as proteins, cells, and so on, which are prone to degradation and/or inactivation under a number of harsh chemical or environmental conditions. Therefore, the present silk fibroin materials of the present invention may be embedded or coated with at least one biologically active agent, such as: organic materials such as red blood cells, horseradish peroxidase, phenolsulfonphthalein, nucleic acid, a dye, a cell, an antibody, enzymes, for example, peroxidase, lipase, amylose, organophosphate dehydrogenase, ligases, restriction endonucleases, ribonucleases, DNA polymerases, glucose oxidase, laccase, cells, viruses, proteins, peptides, small molecules (e.g., drugs, dyes, amino acids, vitamins, antioxidants), DNA, RNA, RNAi, lipids, nucleotides, aptamers, carbohydrates, chromophores, light emitting organic compounds such as luciferin, carotenes and light emitting inorganic compounds (such as chemical dyes), antibiotics, antifungals, antivirals, light harvesting compounds such as chlorophyll, bacteriorhodopsin, proteorhodopsin, and porphyrins and related electronically active compounds, tissues or other living materials, other compounds or combinations thereof. The embedded organic materials are biologically active, thereby adding biological functionality to the resultant structure.

In some embodiments, resolution of about 200 nm can be achieved for printers with fine nozzle size and the access to control the nozzle operating performance (for example, firing voltage and waveform, cleaning cycle, printing temperature and etc.). In some embodiments, resolution that can be achieved by the water lithography methods described herein is about 150 nm, about 175 nm, about 200 nm, about 225 nm, about 250 nm, about 275 nm, about 300 nm, about 325 nm, about 350 nm, about 375 nm, about 400 nm, about 425 nm, about 450 nm, about 475 nm, about 500 nm, about 525 nm, about 550 nm, about 575 nm, about 600 nm, about 625 nm, about 650 nm, about 675 nm, about 700 nm, about 725 nm, about 750 nm, about 775 nm, about 800 nm, about 825 nm, about 850 nm, about 875 nm, about 900 nm, about 925 nm, about 950 nm, about 975 nm, about 1000 nm.

In some embodiments, water lithography described herein constitutes "positive" lithography. Non-treated (e.g., non-annealed, non-crosslinked) silk fibroin materials, such as solidified silk films, can be used. When not annealed or crystallized, such silk films can easily dissolve in an aqueous environment, e.g., water. Using such a silk film as a printing surface (much like a sheet of paper), a printing step can be carried out with the use of water or water-containing agent (much like an ink). This step may be performed by the use of an inkjet printer. A desired, or predetermined pattern may be "drawn" or "printed" upon the silk film with the "water ink."

According to the invention, in some embodiments, such silk films are prepared by spin coating or casting a fibroin solution on desired substrates. In some embodiments, such silk films are prepared by spin coating or casting a pure fibroin solution (e.g., without HFIP) on desired substrates. Upon contact, water molecules can dissolve the silk fibroin-based film, leaving physical "marks" that correspond to the portion or portions of silk fibroin surface contacted with water, reproducing the predetermined pattern drawn or printed thereon. No further treatment is required.

In some embodiments, water lithography described herein constitutes "negative" lithography. Again, non-treated (e.g., non-annealed, non-crosslinked) silk fibroin materials, such as solidified silk films, can be used. When not annealed or crystallized, such solidified silk materials can easily dissolve in an aqueous environment, e.g., water. Using such a silk material (such as silk film) as a printing surface (much like a sheet of paper), a printing step can be carried out with the use of "an ink composition" comprising at least one immobilizing agent, such as at least one crosslinking agent. The presence of such immobilizers or crosslinkers in the ink can induce or facilitate the molecular immobilization or chemical crosslinking of silk fibroin molecules selectively at the site of contact. Therefore, crosslinking reaction can form insoluble silk fibroin where printed (e.g., contacted). Upon selective immobilization drawn or printed upon a predetermined portion of a silk fibroin material, the material may then be subjected to water treatment, which dissolves the portion or portions of the silk fibroin material that is not immobilized and thus remained water-soluble. The resulting (or "developed") structure comprises at least one portion of silk fibroin that is immobilized and water-insoluble.

In the context of the present application, the term "crosslinking" is used to encompass any suitable means of immobilizing silk fibroin at the molecular level, so as to render the silk fibroin material water-insoluble. Accordingly, when silk fibroin protein is "immobilized," silk fibroin materials comprising such silk fibroin protein are said to be insoluble in an aqueous environment (e.g., water). On the other hand, when silk fibroin protein is not immobilized, silk fibroin materials comprising such silk fibroin protein are said to be soluble in an aqueous environment (e.g., water). A silk fibroin material can thus be selectively immobilized or selectively not immobilized in a predetermined spatial pattern (e.g., topography). This allows portions of the silk fibroin material corresponding to immobilized silk fibroin to be rendered insoluble in water, and such portions of the silk fibroin material will withstand water treatment without dissolving, or without dissolving substantially. Portions of the silk fibroin material that are not immobilized are soluble and therefore may easily be washed away (or dissolved) with the use of a water-based agent, such as de-ionized water or an appropriate buffer, in so-called the "developing" step in carrying out lithography. As described in further details herein, the process can be controlled at the nano-scale level, allowing fabrication of nanostructures that correspond to portions of silk fibroin that are selectively immobilized or not immobilized.

Accordingly, the invention encompasses a silk fibroin material comprising at least one portion that is immobilized and at least one portion that is not immobilized. The at least one portion that is immobilized corresponds to a water-insoluble portion, and the at least one portion that is not immobilized corresponds to a water-soluble portion. In some embodiments, a silk fibroin material comprises a first portion that is immobilized and a second portion that is not immobilized, where the first and second portions are formed in a predetermined pattern, random pattern, or combination thereof.

In some embodiments, the invention provides a silk fibroin material comprising at least one portion that is water-insoluble and at least one portion that is water-soluble (or dissolvable). The at least one portion that is water-insoluble corresponds to an immobilized or crosslinked portion, and the at least one portion that is water-soluble corresponds to a portion that is not crosslinked or annealed. In some embodiments, a silk fibroin material comprises a first portion that is water-insoluble and a second portion that is water-soluble, where the first and second portions are formed in a predetermined pattern, random pattern, or combination thereof.

In the context of the present application, therefore, immobilization or crosslinking may be achieved by suitable means to structurally stabilize silk fibroin. In some embodiments, silk fibroin is structurally stabilized by annealing.

The process of annealing involves increased non-covalent interactions of silk fibroin molecules to induce the formation of beta sheet secondary structures. Such non-covalent interactions may include intra-molecular interactions, inter-molecular interactions, or both. Typically, non-covalent interactions are mediated by hydrogen bonds, as well as hydrophobic interactions of silk fibroin molecules, which are associated with increased beta sheet formation. Upon reaching a certain critical level of beta sheet content, silk fibroin is rendered insoluble in an aqueous condition. This phenomenon is generally associated with greater crystallinity, and the status of such silk fibroin is referred to as the Silk II structure. Thus, "annealing" involves non-covalent interactions (e.g., the hydrogen bonds, hydrophobic interactions, etc.), which favor structural shift of silk fibroin into higher beta sheet content, such that silk fibroin is crystallized and thus made insoluble.

In some embodiments, silk fibroin is structurally stabilized by formation of covalent bonds in silk fibroin, e.g., crosslinking As used herein, the term "crosslinking" (or "cross-linking") refers to the formation of covalent bonds involving silk fibroin molecules. Crosslinking can immobilize silk fibroin molecules such that crosslinked silk fibroin material is insoluble in water. Unlike the process of annealing, however, this mode of immobilization does not necessarily depend on the formation of beta sheet structures within silk fibroin. Rather, crosslinked silk fibroin molecules are "fixed in place" so-to-speak, via covalent bonds.

In some embodiments, the process of crosslinking involves the formation of free radicals. In some embodiments, the process of crosslinking involves the radiolysis of water molecules. In some embodiments, the process of crosslinking preferentially affects certain amino acid residues of silk fibroin polypeptides. In some embodiments, the process of crosslinking preferentially affects tyrosine residues of silk fibroin polypeptides. In some embodiments, the process of crosslinking involves tyrosyl radicals. In some embodiments, crosslinking is induced in silk fibroin comprising extra tyrosine residues, as compared to the native (or wild type) silk fibroin polypeptide sequence. In some embodiments, recombinantly produced silk fibroin is used for crosslinking In some embodiments, silk fibroin is enriched with hydrophobic fragments of the silk fibroin polypeptide. In some embodiments, crosslinking comprises the use of at least one crosslinking agents, such as polymers and linkers. In some embodiments, such crosslinking agents form covalent bonds with silk fibroin molecules via reactive groups.

In some embodiments, suitable immobilizing agents are crosslinking agents. These include, but are not limited to: chemical crosslinkers, organic solvents, such as alcohols (e.g., methanol, ethanol, isopropanol, etc.) and acetone, certain polymers that facilitate covalent linkage formation, certain amphiphilic agents such as surfactants that promote the crosslinking process, and so on. It was surprisingly found that certain surfactants, such as nonionic detergents, are able to induce or facilitate the process of crosslinking in silk fibroin. Accordingly, in some embodiments, suitable ink compositions to be used for carrying out "negative" lithography may comprise at least one surfactant as a crosslinking agent. In some embodiments, ink compositions to be used for carrying out "negative" lithography comprise at least one polysorbate. Non-limiting examples of polysorbates include but are not limited to: polysorbate 20, polysorbate 40, polysorbate 60, polysorbate 80, or any combinations thereof.

In any of these embodiments, such ink compositions to be used for carrying out "negative" lithography may contain at least one crosslinking agent ranging between about 0.1 wt % and about 30 wt % of the composition. In some embodiments, such ink compositions to be used for carrying out "negative" lithography may contain at least one crosslinking agent ranging between about 0.1-25 wt %, between about 0.1-20 wt %, between about 0.1-15 wt %, between about 0.1-10 wt %, between about 0.1-5 wt %, between about 0.5-30 wt %, between about 0.5-25 wt %, between about 0.5-20 wt %, between about 0.5-15 wt %, between about 0.5-10 wt %, between about 0.5-5 wt %, between about 1-30 wt %, between about 1-25 wt %, between about 1-20 wt %, between about 1-15 wt %, between about 1-10 wt %, between about 1-5 wt %, between about 2-30 wt %, between about 2-25 wt %, between about 2-20 wt %, between about 2-15 wt %, between about 2-10 wt %, between about 2-5 wt %, between about 3-30 wt %, between about 3-25 wt %, between about 3-20 wt %, between about 3-15 wt %, between about 3-10 wt %, between about 3-5 wt %, between about 5-30 wt %, between about 5-25 wt %, between about 5-20 wt %, between about 5-15 wt %, between about 5-10 wt %, between about 0.1-5 wt %, between about 0.1-4 wt %, between about 0.1-3 wt %, between about 0.1-2 wt %, between about 0.1-2 wt %, between about 0.1-1 wt %, between about 0.1-0.5 wt %.

In some embodiment, crosslinking agents may include, without limitation, chemical linkers with reactive groups to induce covalent bond formation, enzymes with polymerizing activities, and so on. In some embodiments, crosslinking process may include the formation of free radicals. In some embodiments, for example, formation of radicals involves aromatic residues, such as tyrosine residues. In some embodiments, formation of radicals involves splitting of water molecules via radiolysis.

Accordingly, in one aspect of the invention, the step of printing therefore corresponds to immobilizing or crosslinking This step may be performed by the use of an inkjet printer. A desired, or predetermined pattern may be "drawn" or "printed" upon the silk film with the "ink composition" comprising at least one immobilizing agent or at least one crosslinking agent, as stated above. Non-treated (not printed) portions of silk films will remain water-soluble and therefore can be dissolved in water, or otherwise washed away. The portions that are immobilized or crosslinked will become water-resistant, or insoluble, thus remain intact, resulting in the printed pattern.

In sum, the present disclosure includes, to the best of the knowledge of the inventors, the first demonstration of truly water-only lithography.

The following examples are provided for illustrative purposes only and are not to be construed in any way to be limiting.

EXAMPLES

Silk Fibroin Extraction

To yield ~40 mL of silk fibroin solution with a concentration of ~6.25% (wt/vol), the following protocol has been successfully carried out. For larger volumes, the ingredients may be scaled appropriately.

1) Cut *Bombyx mori* silk cocoons (10 gram) into half-dime-sized pieces and dispose of silkworms;
2) Measure 8.48 gram of sodium carbonate and add it into 4 liter of boiled water in a 5 liter glass beaker (to prepare a 0.02 M solution);
3) Boil the silk (varying from 10 minutes to 2 hours, depending on applications);
4) Remove the silk fibroin with a strainer and cool it by rinsing in ultrapure cold water for 20 minutes and repeat twice for a total of three rinses;
5) After the third rinse, remove the silk fibroin and squeeze the water;
6) Spread the squeezed silk fibroin, spread it out and let it dry in a fume hood for 12 hours, which results in silk fibroin weighing slightly over 2.5 gram;
7) Dissolve 2.5 gram of silk fibroin into 10 mL of 9.3 M lithium bromide;
8) The silk fibroin should dissolve completely in a few minutes upon stirring;
9) Insert 10 mL of the silk-LiBr solution into a pre-wet 3-12-mL dialysis cassette and dialyze against 1 liter of ultrapure water for 48 hours (change the water every 6 hours);
10) Remove silk from the cassette;
11) Place the silk solution in a centrifuge and spin at 9,000 r.p.m. at 2 degree C. for 60 minutes, and store the centrifuged silk solution (~40 mL of silk solution with a concentration of ~6.25%) in a refrigerator at 4 degree C.

Silk Fibroin Substrates/Films Preparation

Silk fibroin films can be, for example, prepared by spin coating and casting the silk fibroin solution on desired substrates. After drying, the silk films can be used as attached on the spin coated or cast substrates or can be peeled off and used as freestanding forms as well. The thickness of silk films can be precisely controlled within a range of a few nanometers to hundreds of microns, which depends on spin coating rate, the amount and concentration of applied silk solution.

Preparation of Functional Silk Fibroin Film by Adding Appropriate Dopants

The to-be-patterned silk films can be easily functionalized by mixing in suitable dopants (one dopant or a combination of compatible dopants). Examples of dopants include but are not limited to the followings: nanoparticles, such as metallic and inorganic particles; dyes; drugs, such as small molecules and biologics; proteins, such as enzymes, antigens, antibodies and fragments thereof; microorganisms, such as bacteria, viruses and viral particles; cells such as prokaryotic and eukaryotic cells; and any combinations thereof.

Micro-/Nano-patterning of Silk Fibroin Films Using an Inkjet Printer with Water Based Solution The as-prepared silk films can be used in either positive water-lithography or negative water-lithography fashion in accordance with the invention.

Figure 4:
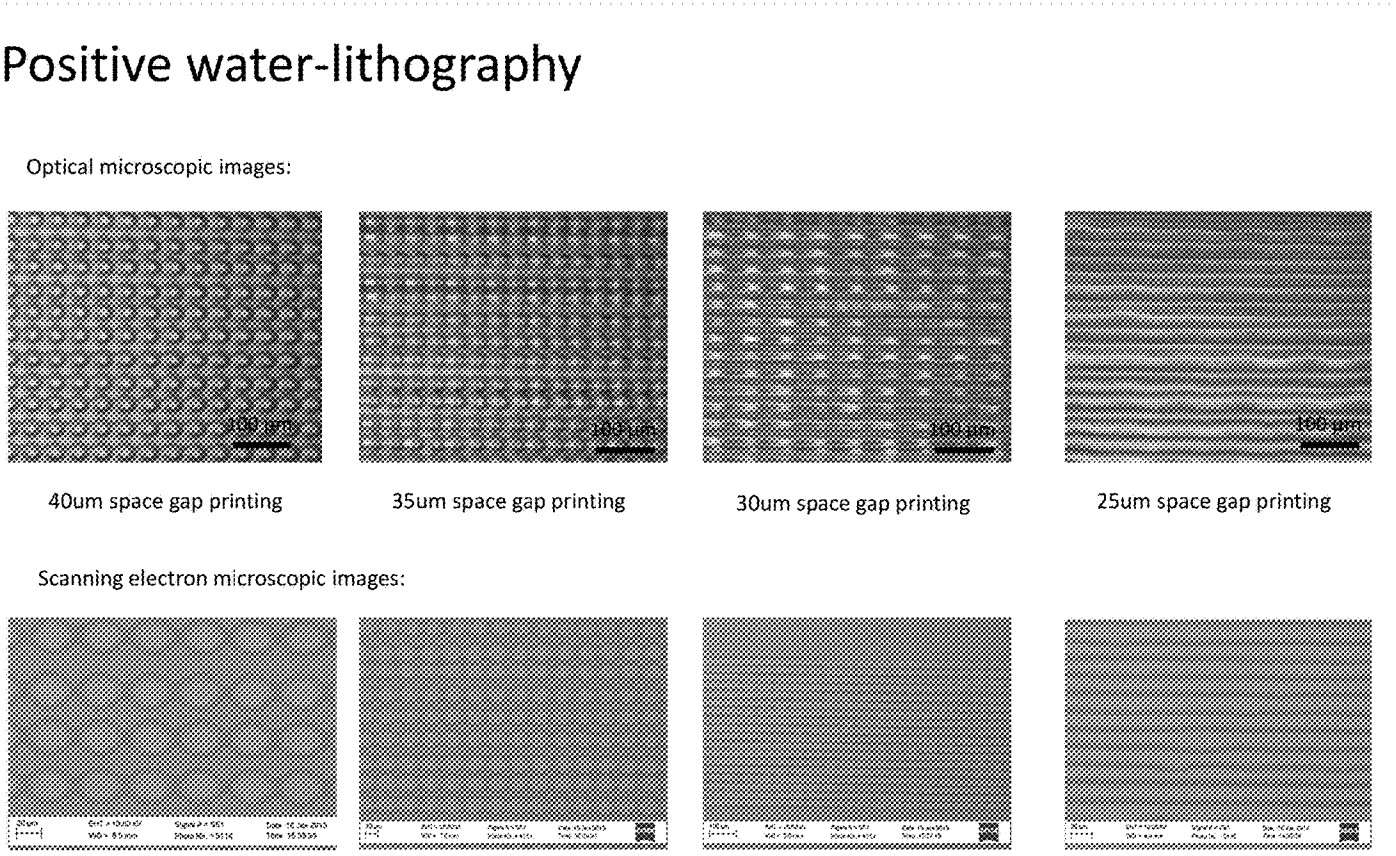
FIG. 4 provides four sets of "positive" water lithography images with varying space gaps. The top row shows optical microscopic images; while the bottom row shows scanning electron microscopic (SEM) images. From left to right, the distance of space gap used for printing are: 40 μm, 35 μm, 30 μm and 25 μm.

In positive water-lithography, the silk region dissolves upon printing, and therefore no further pattern development is needed. Non-treated silk films having with low crystalline levels dissolve in water easily. By printing water on desired patterning region using an inkjet printer, the region exposed to the water dissolves, leaving a lower surface profile compared to non-printed region. To illustrate feasibility of the mode of the invention, non-limiting examples of positive lithography are provided in FIG. 4.

Figure 5:
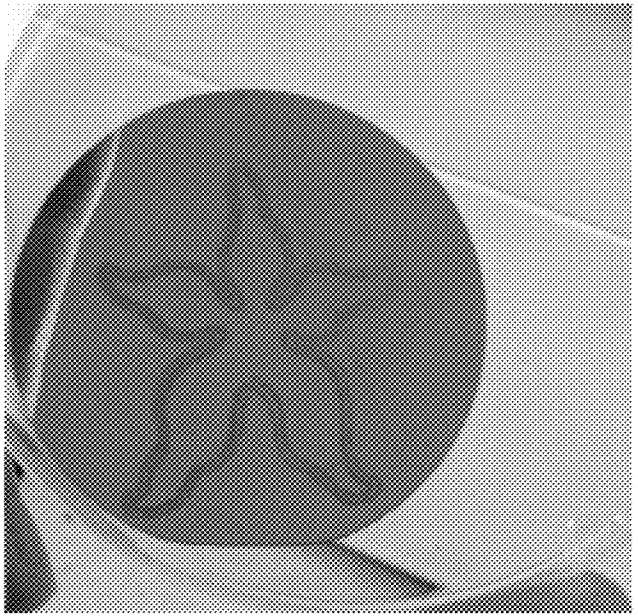
FIG. 5 depicts an exemplary image of "negative" water lithography. The image shows a complex mix of straight and curved lines, that are both radial and predominantly symmetrical.
Figure 6:
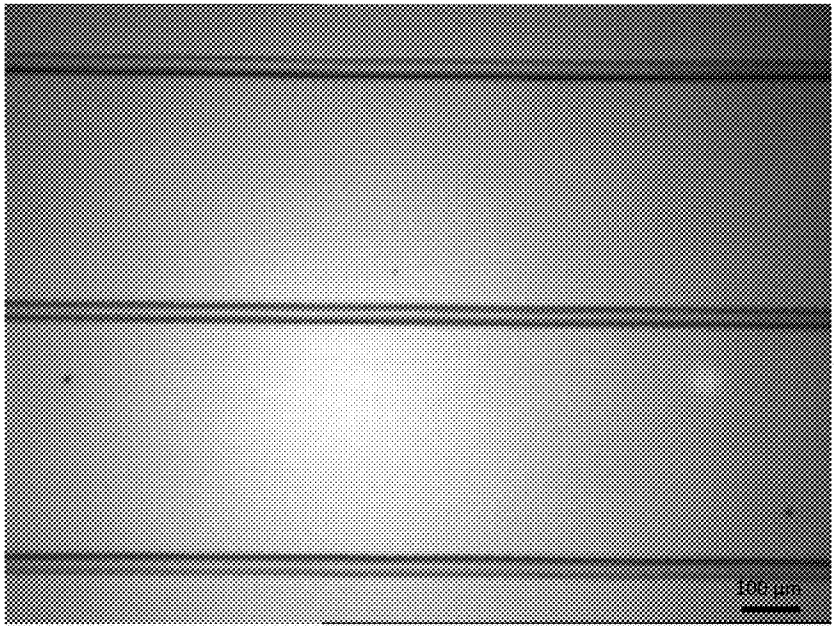
FIG. 6 provides an exemplary image of "negative" water lithography patterns, depicting silk lines after being developed in water.

In negative water-lithography, on the other hand, the silk region remains upon printing after pattern development by rinsing in water. Non-treated silk films having with low crystalline levels dissolve in water easily, but can be rendered to be water-insoluble by immobilizing or crosslinking the silk fibroin matrix (e.g., through chemical and non-chemical annealing methods) and thus increasing the crystalline level. By applying crosslinker-based "ink" solution (e.g., tween, methanol, enzyme, etc.) on desired patterning region using an inkjet printer, silk fibroin within the printed region is cross-linked, rendering the portion water-insoluble. After "developing" the entire film by rinsing in the water, non-printed region will dissolve (i.e., washed away) and disappear while the printed region stays due to the induced crosslink. To illustrate feasibility of the mode of the invention, non-limiting examples of negative lithography are provided in FIGS. 5 and 6.

High resolution (such as up to 200 nm) can be achieved for printers with fine nozzle size and the access to control the nozzle operating performance, for example, firing voltage and waveform, cleaning cycle, printing temperature and etc.

Printing Patterns Using Water-lithography

The printable patterns using water based solution on silk fibroin films are limitless, simply depending on the available inkjet printers. The printable silk patterns include, but not limited to, the following: lines, curves, dots, solids, and combinations thereof.

SEQUENCE LISTING

```
<160> NUMBER OF SEQ ID NOS: 22

<210> SEQ ID NO 1
<211> LENGTH: 90
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (7)..(90)
```

<223> OTHER INFORMATION: Wherein any of residues 7-90 may be missing.

<400> SEQUENCE: 1

Gly Ala Gly Ala Gly Ser Gly Ala Gly Ala Gly Ser Gly Ala Gly Ala
1 5 10 15

Gly Ser Gly Ala Gly Ala Gly Ser Gly Ala Gly Ala Gly Ser Gly Ala
20 25 30

Gly Ala Gly Ser Gly Ala Gly Ala Gly Ser Gly Ala Gly Ala Gly Ser
35 40 45

Gly Ala Gly Ala Gly Ser Gly Ala Gly Ala Gly Ser Gly Ala Gly Ala
50 55 60

Gly Ser Gly Ala Gly Ala Gly Ser Gly Ala Gly Ala Gly Ser Gly Ala
65 70 75 80

Gly Ala Gly Ser Gly Ala Gly Ala Gly Ser
85 90

<210> SEQ ID NO 2
<211> LENGTH: 30
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (2)..(2)
<223> OTHER INFORMATION: Wherein X is V, I or A.
<220> FEATURE:
<221> NAME/KEY: MISC_FEATURE
<222> LOCATION: (3)..(30)
<223> OTHER INFORMATION: Wherein any of residues 3-30 may be missing
<220> FEATURE:
<221> NAME/KEY: MISC_FEATURE
<222> LOCATION: (4)..(4)
<223> OTHER INFORMATION: Wherein X is V, I or A.
<220> FEATURE:
<221> NAME/KEY: MISC_FEATURE
<222> LOCATION: (6)..(6)
<223> OTHER INFORMATION: Wherein X is V, I or A.
<220> FEATURE:
<221> NAME/KEY: MISC_FEATURE
<222> LOCATION: (8)..(8)
<223> OTHER INFORMATION: Wherein X is V, I or A.
<220> FEATURE:
<221> NAME/KEY: MISC_FEATURE
<222> LOCATION: (10)..(10)
<223> OTHER INFORMATION: Wherein X is V, I or A.
<220> FEATURE:
<221> NAME/KEY: MISC_FEATURE
<222> LOCATION: (12)..(12)
<223> OTHER INFORMATION: Wherein X is V, I or A.
<220> FEATURE:
<221> NAME/KEY: MISC_FEATURE
<222> LOCATION: (14)..(14)
<223> OTHER INFORMATION: Wherein X is V, I or A.
<220> FEATURE:
<221> NAME/KEY: MISC_FEATURE
<222> LOCATION: (16)..(16)
<223> OTHER INFORMATION: Wherein X is V, I or A.
<220> FEATURE:
<221> NAME/KEY: MISC_FEATURE
<222> LOCATION: (18)..(18)
<223> OTHER INFORMATION: Wherein X is V, I or A.
<220> FEATURE:
<221> NAME/KEY: MISC_FEATURE
<222> LOCATION: (20)..(20)
<223> OTHER INFORMATION: Wherein X is V, I or A.
<220> FEATURE:
<221> NAME/KEY: MISC_FEATURE
<222> LOCATION: (22)..(22)
<223> OTHER INFORMATION: Wherein X is V, I or A.
<220> FEATURE:
<221> NAME/KEY: MISC_FEATURE <222> LOCATION: (24)..(24)
<223> OTHER INFORMATION: Wherein X is V, I or A.
<220> FEATURE:
<221> NAME/KEY: MISC_FEATURE
<222> LOCATION: (26)..(26)
<223> OTHER INFORMATION: Wherein X is V, I or A.
<220> FEATURE:
<221> NAME/KEY: MISC_FEATURE
<222> LOCATION: (28)..(28)
<223> OTHER INFORMATION: Wherein X is V, I or A.
<220> FEATURE:
<221> NAME/KEY: MISC_FEATURE
<222> LOCATION: (30)..(30)
<223> OTHER INFORMATION: Wherein X is V, I or A.

<400> SEQUENCE: 2

Gly Xaa Gly Xaa Gly Xaa Gly Xaa Gly Xaa Gly Xaa Gly Xaa Gly Xaa
1 5 10 15

Gly Xaa Gly Xaa Gly Xaa Gly Xaa Gly Xaa Gly Xaa Gly Xaa
20 25 30

<210> SEQ ID NO 3
<211> LENGTH: 4
<212> TYPE: PRT
<213> ORGANISM: Bombyx mori

<400> SEQUENCE: 3

Gly Ala Ala Ser
1

<210> SEQ ID NO 4
<211> LENGTH: 15
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (2)..(2)
<223> OTHER INFORMATION: Wherein residue S may be missing
<220> FEATURE:
<221> NAME/KEY: MISC_FEATURE
<222> LOCATION: (14)..(15)
<223> OTHER INFORMATION: Wherein any of residues 14-15 may be missing

<400> SEQUENCE: 4

Ser Ser Ala Ala Ala Ala Ala Ala Ala Ala Ala Ala Ala Ala Ala
1 5 10 15

<210> SEQ ID NO 5
<211> LENGTH: 8
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (2)..(5)
<223> OTHER INFORMATION: Wherein any of residues 2-5 may be missing
<220> FEATURE:
<221> NAME/KEY: MISC_FEATURE
<222> LOCATION: (2)..(2)
<223> OTHER INFORMATION: Wherein X is any residue
<220> FEATURE:
<221> NAME/KEY: MISC_FEATURE
<222> LOCATION: (3)..(3)
<223> OTHER INFORMATION: Wherein X is any residue
<220> FEATURE:
<221> NAME/KEY: MISC_FEATURE
<222> LOCATION: (4)..(4)
<223> OTHER INFORMATION: Wherein X is any residue
<220> FEATURE:

<221> NAME/KEY: MISC_FEATURE
<222> LOCATION: (5)..(5)
<223> OTHER INFORMATION: Wherein X is any residue
<220> FEATURE:
<221> NAME/KEY: MISC_FEATURE
<222> LOCATION: (8)..(8)
<223> OTHER INFORMATION: Wherein X is any residue

<400> SEQUENCE: 5

Gly Xaa Xaa Xaa Xaa Gly Gly Xaa
1 5

<210> SEQ ID NO 6
<211> LENGTH: 4
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (4)..(4)
<223> OTHER INFORMATION: Wherein X is A, S, Y, R, D, V or W

<400> SEQUENCE: 6

Gly Gly Gly Xaa
1

<210> SEQ ID NO 7
<211> LENGTH: 12
<212> TYPE: PRT
<213> ORGANISM: Artificial Sequence
<220> FEATURE:
<223> OTHER INFORMATION: Synthetic polypeptide
<220> FEATURE:
<221> NAME/KEY: MISC_FEATURE
<222> LOCATION: (2)..(2)
<223> OTHER INFORMATION: Wherein residue S may be missing
<220> FEATURE:
<221> NAME/KEY: MISC_FEATURE
<222> LOCATION: (4)..(6)
<223> OTHER INFORMATION: Wherein any residues 4-6 may be missing

<400> SEQUENCE: 7

Ser Ser Ala Ala Ala Ala Ser Ser Ala Ala Ala Ala
1 5 10

<210> SEQ ID NO 8
<211> LENGTH: 6
<212> TYPE: PRT
<213> ORGANISM: Galleria mellonella

<400> SEQUENCE: 8

Gly Leu Gly Gly Leu Gly
1 5

<210> SEQ ID NO 9
<211> LENGTH: 6
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (2)..(2)
<223> OTHER INFORMATION: Wherein X is L, I, V or P
<220> FEATURE:
<221> NAME/KEY: MISC_FEATURE
<222> LOCATION: (5)..(5)
<223> OTHER INFORMATION: Wherein X is L, I, V or P

<400> SEQUENCE: 9

Gly Xaa Gly Gly Xaa Gly
1 5

<210> SEQ ID NO 10
<211> LENGTH: 21
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (5)..(5)
<223> OTHER INFORMATION: Wherein X is Y, V, S or A
<220> FEATURE:
<221> NAME/KEY: MISC_FEATURE
<222> LOCATION: (6)..(20)
<223> OTHER INFORMATION: Wherein any of 6-20 may be missing
<220> FEATURE:
<221> NAME/KEY: MISC_FEATURE
<222> LOCATION: (10)..(10)
<223> OTHER INFORMATION: Wherein X is Y, V, S or A
<220> FEATURE:
<221> NAME/KEY: MISC_FEATURE
<222> LOCATION: (15)..(15)
<223> OTHER INFORMATION: Wherein X is Y, V, S or A
<220> FEATURE:
<221> NAME/KEY: MISC_FEATURE
<222> LOCATION: (20)..(20)
<223> OTHER INFORMATION: Wherein X is Y, V, S or A

<400> SEQUENCE: 10

Gly Pro Gly Gly Xaa Gly Pro Gly Gly Xaa Gly Pro Gly Gly Xaa Gly
1 5 10 15

Pro Gly Gly Xaa Tyr
20

<210> SEQ ID NO 11
<211> LENGTH: 5
<212> TYPE: PRT
<213> ORGANISM: Argiope trifasciata

<400> SEQUENCE: 11

Gly Arg Gly Gly Ala
1 5

<210> SEQ ID NO 12
<211> LENGTH: 13
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (5)..(10)
<223> OTHER INFORMATION: Wherein any of 5-10 may be missing

<400> SEQUENCE: 12

Gly Ala Gly Ala Ala Ala Ala Ala Ala Ala Gly Gly Ala
1 5 10

<210> SEQ ID NO 13
<211> LENGTH: 8
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (3)..(3)
<223> OTHER INFORMATION: Wherein X is Q, Y, L, A, S or R <220> FEATURE:
<221> NAME/KEY: MISC_FEATURE
<222> LOCATION: (5)..(5)
<223> OTHER INFORMATION: Wherein X is Q, Y, L, A, S or R
<220> FEATURE:
<221> NAME/KEY: MISC_FEATURE
<222> LOCATION: (7)..(7)
<223> OTHER INFORMATION: Wherein X is Q, Y, L, A, S or R
<220> FEATURE:
<221> NAME/KEY: MISC_FEATURE
<222> LOCATION: (8)..(8)
<223> OTHER INFORMATION: Wherein X is Q, Y, L, A, S or R

<400> SEQUENCE: 13

Gly Gly Xaa Gly Xaa Gly Xaa Xaa
1 5

<210> SEQ ID NO 14
<211> LENGTH: 16
<212> TYPE: PRT
<213> ORGANISM: Bombyx mori

<400> SEQUENCE: 14

Thr Gly Ser Ser Gly Phe Gly Pro Tyr Val Asn Gly Gly Tyr Ser Gly
1 5 10 15

<210> SEQ ID NO 15
<211> LENGTH: 8
<212> TYPE: PRT
<213> ORGANISM: Bombyx mandarina

<400> SEQUENCE: 15

Tyr Glu Tyr Ala Trp Ser Ser Glu
1 5

<210> SEQ ID NO 16
<211> LENGTH: 7
<212> TYPE: PRT
<213> ORGANISM: Antheraea mylitta

<400> SEQUENCE: 16

Ser Asp Phe Gly Thr Gly Ser
1 5

<210> SEQ ID NO 17
<211> LENGTH: 7
<212> TYPE: PRT
<213> ORGANISM: Antheraea yamamai

<400> SEQUENCE: 17

Arg Arg Ala Gly Tyr Asp Arg
1 5

<210> SEQ ID NO 18
<211> LENGTH: 8
<212> TYPE: PRT
<213> ORGANISM: Galleria mellonella

<400> SEQUENCE: 18

Glu Val Ile Val Ile Asp Asp Arg
1 5

<210> SEQ ID NO 19
<211> LENGTH: 18
<212> TYPE: PRT
<213> ORGANISM: Nephila madascariensis -continued

```
<400> SEQUENCE: 19

Thr Thr Ile Ile Glu Asp Leu Asp Ile Thr Ile Asp Gly Ala Asp Gly
1               5                   10                  15

Pro Ile


<210> SEQ ID NO 20
<211> LENGTH: 8
<212> TYPE: PRT
<213> ORGANISM: Nephila clavipes

<400> SEQUENCE: 20

Thr Ile Ser Glu Glu Leu Thr Ile
1               5


<210> SEQ ID NO 21
<211> LENGTH: 6
<212> TYPE: PRT
<213> ORGANISM: Artificial sequence
<220> FEATURE:
<223> OTHER INFORMATION: Synthetic polypeptide

<400> SEQUENCE: 21

Gly Ser Gly Ala Gly Ala
1               5


<210> SEQ ID NO 22
<211> LENGTH: 5
<212> TYPE: PRT
<213> ORGANISM: Artificial sequence
<220> FEATURE:
<223> OTHER INFORMATION: Synthetic polypeptide
<220> FEATURE:
<221> NAME/KEY: MISC_FEATURE
<222> LOCATION: (4)..(4)
<223> OTHER INFORMATION: Wherein X is any residue
<220> FEATURE:
<221> NAME/KEY: MISC_FEATURE
<222> LOCATION: (5)..(5)
<223> OTHER INFORMATION: Wherein X is any residue

<400> SEQUENCE: 22

Gly Pro Gly Xaa Xaa
1               5
```

The invention claimed is:

1. A method comprising the steps of:

providing a silk fibroin material, wherein the silk fibroin material is solidified and having a beta-sheet content of no greater than 35%;

depositing an ink composition comprising water onto a first portion of the silk fibroin material in a predetermined spatial pattern, so as to dissolve silk fibroin in the first portion.

2. The method of claim 1, wherein the silk fibroin material is a silk film.

3. The method of claim 2, wherein the silk film has a thickness of between about 20 nm and about 1,000 nm.

4. The method of claim 1, wherein the silk fibroin material comprises at least one dopant associated therewith, such that the dopant is incorporated therein, coated thereon, or combination thereof.

5. The method of claim 4, wherein the at least one dopant is or comprises:

a particle, a dye, a drug, a biologic, a protein, an enzyme, an antibody, an antigen, a cytokine, a hormone, a peptide, a chemokine, an organic small molecule, a virus, a cell, a nucleic acid, a label, a toxin, any fragments thereof, or any combinations thereof.

6. The method of claim 1, wherein the ink composition consists essentially of water.

7. The method of claim 1, wherein the depositing step is performed with an inkjet printer.

8. The method of claim 1, wherein the predetermined spatial pattern comprises a line, a curve, a dot, a solid form, a letter, a number, or any combinations thereof.

9. The method of claim 1, wherein the predetermined spatial pattern comprises an identification code.

10. The method of claim 1, wherein the predetermined spatial pattern provides a resolution up to 200 nm.

11. A method for crosslinking a soluble silk fibroin material, comprising the steps of:

providing a silk fibroin material, wherein the silk fibroin material is solidified and having a beta-sheet content of no greater than 35%;

depositing an ink composition comprising water and an immobilizing agent onto a first portion of the silk fibroin material in a predetermined spatial pattern;

treating the silk fibroin material with a water-based agent, so as to dissolve portions of the silk fibroin material not deposited with the ink composition.

12. The method of claim 11, wherein the silk fibroin material is a silk film.

13. The method of claim 12, wherein the silk film has a thickness of between about 20 nm and about 1,000 nm.

14. The method of claim 11, wherein the silk fibroin material comprises at least one dopant associated therewith, such that the dopant is incorporated therein, coated thereon, or combination thereof.

15. The method of claim 14, wherein the at least one dopant is or comprises:

a particle, a dye, a drug, a biologic, a protein, an enzyme, an antibody, an antigen, a cytokine, a hormone, a peptide, a chemokine, an organic small molecule, a virus, a cell, a nucleic acid, a label, a toxin, any fragments thereof, or any combinations thereof.

16. The method of claim 11, wherein the beta-sheet content is no greater than 30%, 25%, 20%, 15%, or 10%.

17. The method of claim 11, wherein the depositing step is performed with an inkjet printer.

18. The method of claim 11, wherein the predetermined spatial pattern comprises a line, a curve, a dot, a solid form, a letter, a number, or any combinations thereof.

19. The method of claim 11, wherein the predetermined spatial pattern comprises an identification code.

20. The method of claim 11, wherein the predetermined spatial pattern provides a resolution up to 200 nm.

* * * * *